US006880703B2

(12) United States Patent
Peña et al.

(10) Patent No.: US 6,880,703 B2
(45) Date of Patent: Apr. 19, 2005

(54) FLORAL TRANSPORT APPARATUS

(75) Inventors: Celene C. Peña, Houston, TX (US); Tracy R. Jackson, Houston, TX (US)

(73) Assignee: Floratite Inc., Houston, TX (US)

( * ) Notice: Subject to any disclaimer, the term of this patent is extended or adjusted under 35 U.S.C. 154(b) by 0 days.

(21) Appl. No.: 10/324,325

(22) Filed: Dec. 20, 2002

(65) Prior Publication Data

US 2004/0118727 A1 Jun. 24, 2004

(51) Int. Cl.[7] ..... B65D 85/52

(52) U.S. Cl. ..... 206/423; 205/583; 205/589; 205/443

(58) Field of Search ..... 206/423, 426, 206/443, 486, 490, 588, 589, 583; 211/74; 47/41

(56) References Cited

U.S. PATENT DOCUMENTS 3,390,783 A * 7/1968 Quackenbush, Jr. ..... 211/73
5,657,868 A 8/1997 Taylor ..... 206/423
5,685,438 A * 11/1997 Emanuel et al. ..... 211/70.1
6,102,204 A 8/2000 Castleberry ..... 206/423
6,164,449 A * 12/2000 Lahti ..... 206/499
6,523,301 B1 * 2/2003 Delaney ..... 47/41.01

OTHER PUBLICATIONS

The Wicki Board/ 1 page.
Tote Tray Delivery System/ 1 page.
Floracube®/ 1 page.
Seminole Floral Delivery System/ 2 pages.
Transporter 10® Delivery System/ 3 pages.

* cited by examiner

*Primary Examiner*—David T. Fidei
(74) *Attorney, Agent, or Firm*—Clarence E. Eriksen; Bryan P. Galloway

(57) ABSTRACT

A floral transport apparatus to facilitate the transportation and delivery of floral arrangements is disclosed. The floral transport apparatus includes a hard plastic container housing a support carriage having a set of longitudinal elastic bands and a set of lateral elastic bands stretched tightly over a box frame to form an upper and lower mesh. The floral arrangement is held securely in the gaps between the tensioned bands of the upper and lower mesh to prevent lateral displacement which would otherwise result in tipping of the floral arrangement. The floral transport apparatus provides a means for carrying many floral arrangements of various sizes simultaneously. Moreover, the floral transport apparatus is easily portable and manageable by a single delivery person and can be washed to keep the apparatus attractive in view of floral customers and potential floral customers.

19 Claims, 8 Drawing Sheets

FLORAL TRANSPORT APPARATUS

BACKGROUND OF THE INVENTION

1. Field of the Invention

The present invention relates to an apparatus for use in the floral industry, and, more particularly, to a floral transport apparatus for facilitating the transport and delivery of floral arrangements.

2. Description of the Prior Art

In the floral industry, a florist creates for delivery a floral arrangement which typically includes a plant or flowers artistically arranged in a vessel. If the arrangement includes a plant, then the vessel (e.g., a pot) typically contains soil to support the roots of the plant. If the arrangement includes flowers, then the vessel (e.g., a vase) typically contains water in which the stems of the flowers are submerged. Once the floral arrangement is created, it is delivered by a delivery person to the customer. Generally, the delivery person uses a car, van, or truck to deliver many floral arrangements per trip. For example, during a single trip to a hospital or a church, the delivery person may have to deliver many floral arrangements to one location. It is important during the transportation of the floral arrangements that the delivery person stabilize each arrangement to prevent tipping and spilling; and, also it is important to isolate each arrangement to protect the vessels from colliding with one another and to prevent the arrangements themselves from becoming disheveled.

There are several devices in the prior art of floral delivery for transporting floral arrangements. For example, U.S. Pat. No. 5,657,868 discloses a floral delivery box apparatus to hold and protect a floral arrangement from damage during delivery. Referring to FIGS. 1 and 2 of the '868 patent, the floral box includes a flat base 14 having wing elements 18 which are stapled to a box 16 for holding a floral arrangement 12. Both the base and the box are fabricated from corrugated cardboard. The device is intended to provide a stable platform to hold the floral arrangement during delivery and to resist internal vehicle forces which might otherwise induce tipping of the floral arrangement. The delivery box of the '868 patent, however, is not able to hold a plurality of floral arrangements thereby requiring the florist to make many trips to and from the delivery vehicle in the event that the florist is transporting many arrangements. Moreover, it has been observed that cardboard floral delivery boxes are not suitable for repeated use since they are easily damaged and cannot support the weight of the floral arrangements once the boxes become wet which is inevitable in the floral industry.

As another example, U.S. Pat. No. 6,102,204 assigned on its face Horticultural Technologies, Inc. discloses a plastic foam container for holding floral articles. Referring to FIG. 1 of the '204 patent, the floral container 10 includes a non-absorbent polystyrene base 12 and a series of container segment members 18 (FIG. 3) made from an absorbent polyurethane foam. Each segment member 18 includes a cutout 22 to form a cylindrical stepped bore 23 having a plurality of inwardly extending fingers 25. The fingers of each bore serve to hold a floral arrangement of variable size and to absorb shock forces during transportation. While the container of the '204 does allow for some variability in the diameter of floral vessels which it can hold, the range is very limited. Moreover, since the foam segment members are absorbent, the container cannot be thoroughly washed and becomes malodorous and unsightly after repeated use. Also, another problem has been observed with managing the container of the '204 patent: While the plastic foam material is light, it is also quite flexible thereby becoming cumbersome for the florist who must carry the container by hand for delivery.

Accordingly, the floral industry would find desirable a stable, non-flexible transport apparatus which has the ability to hold a large range of floral vessel sizes and which is easy to keep clean and to manage during delivery. This novel and useful result has been achieved by the present invention.

SUMMARY OF THE INVENTION

The present invention is directed toward a transport apparatus for facilitating the transport and delivery of one or more articles of various sizes including, but not limited to, floral arrangements. An embodiment of the transport apparatus includes a container having a plurality of walls, a closed bottom base, and an open top end opposite the bottom base. An upper mesh layer is operatively connected to the container at or near the top end; and a lower mesh layer is operatively connected to the container between the bottom base and the upper mesh layer. A plurality of articles may be held in the gaps of the mesh of the upper mesh layer and the lower mesh layer for secure transportation.

In a particular embodiment of the present invention, the upper mesh layer and lower mesh layer are components of a support carriage. The support carriage includes a frame attached to the container for supporting the upper mesh layer and lower mesh layer. The upper mesh layer and lower mesh layer are formed by a set of longitudinal elastic bands and a set of lateral elastic bands arranged in an over-crossing and under-crossing woven pattern over the frame. Each band is separated from adjacent bands by a tubular spacer. The inner-woven sets of longitudinal and lateral bands form the upper and lower mesh layer for securely holding a plurality of articles.

It is an object and feature of the present invention to provide a stable, nonflexible container for holding a plurality of floral arrangements having a large range of sizes during transport and delivery.

It is another object and feature of the present invention to provide a container for holding floral arrangements that is easily maintainable and washable such that the container is tidy and not malodorous.

It is also an object and feature of the present invention to provide a container for holding floral arrangements which is physically manageable by a single operator and which is easily portable.

It is a further object of the present invention to provide a container for holding floral arrangements that is water-tight so as to protect the delivery vehicle from spilled water from the arrangement vessel.

DESCRIPTION OF SPECIFIC EMBODIMENT

The following illustrative description of the present invention is provided to facilitate an understanding of the invention, and is not intended to limit the present invention to any specific form. While the transport apparatus of the present invention is described with respect to a device for holding floral arrangements, it is intended that the apparatus can be used to hold any article requiring stabile containment during transport.

Figure 1:
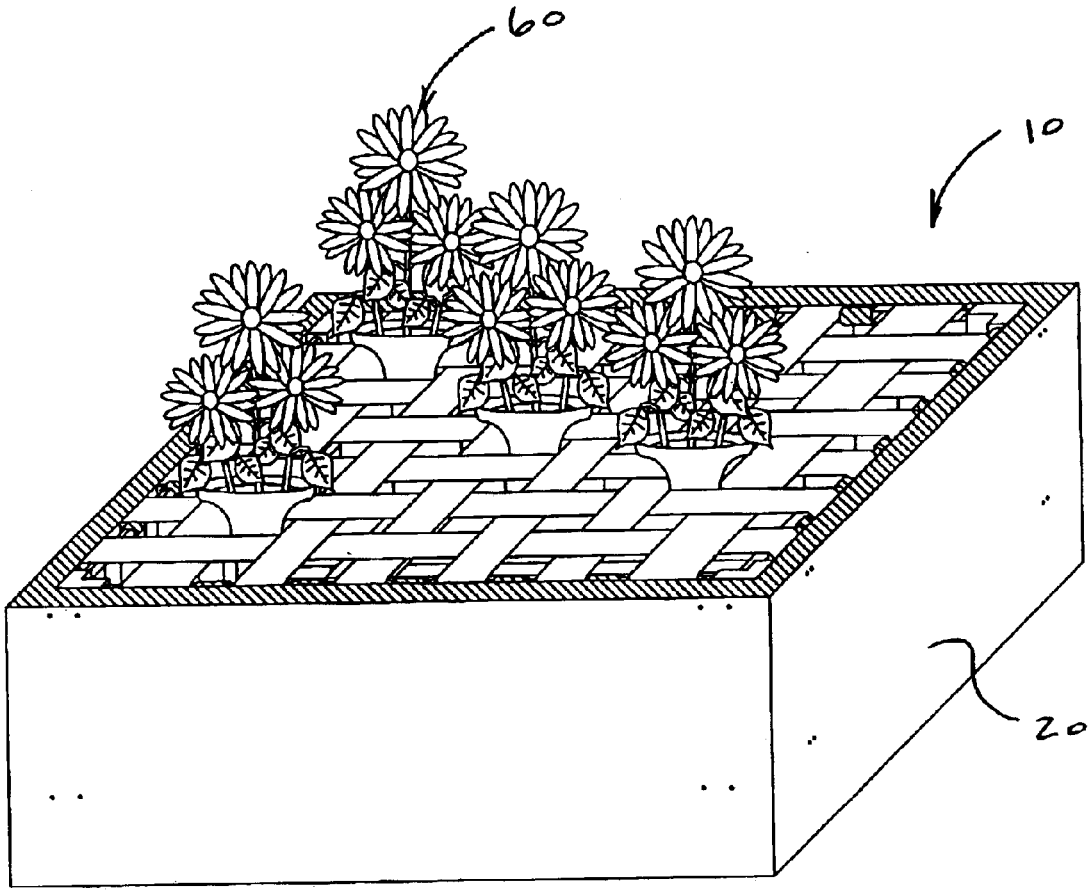
FIG. 1 is a perspective view of an embodiment of the floral transport apparatus of the present invention holding a plurality of floral arrangements.
Figure 2:
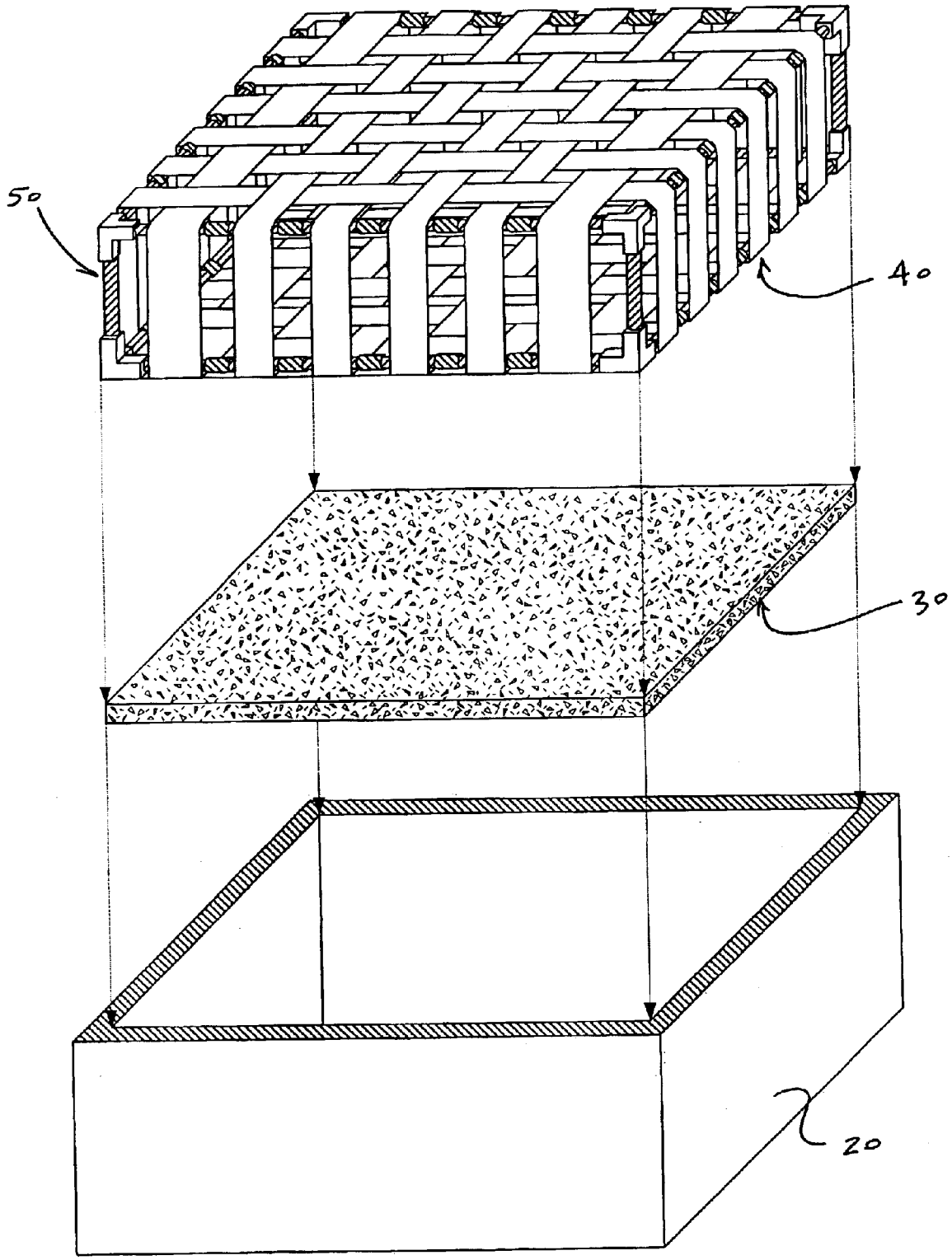
FIG. 2 is a perspective view of an embodiment of the floral transport apparatus depicting the support carriage and base mat for insertion into the container.

With reference to FIGS. 1 and 2, an embodiment of the present invention includes a floral transport device 10 for holding one or more flower arrangements 60. The floral transport device 10 comprises a housing or container 20 having a bottom base, four side walls, and an open top. The container 20 is preferably fabricated from a water-resistant hardened plastic material.

A shock absorbing mat 30 is set in the container 20 on top of the bottom base to support and protect the bottom of each flower arrangement 60. The shock absorbent mat 30 is preferably fabricated from a water-resistant closed-cell sponge material.

Figure 3:
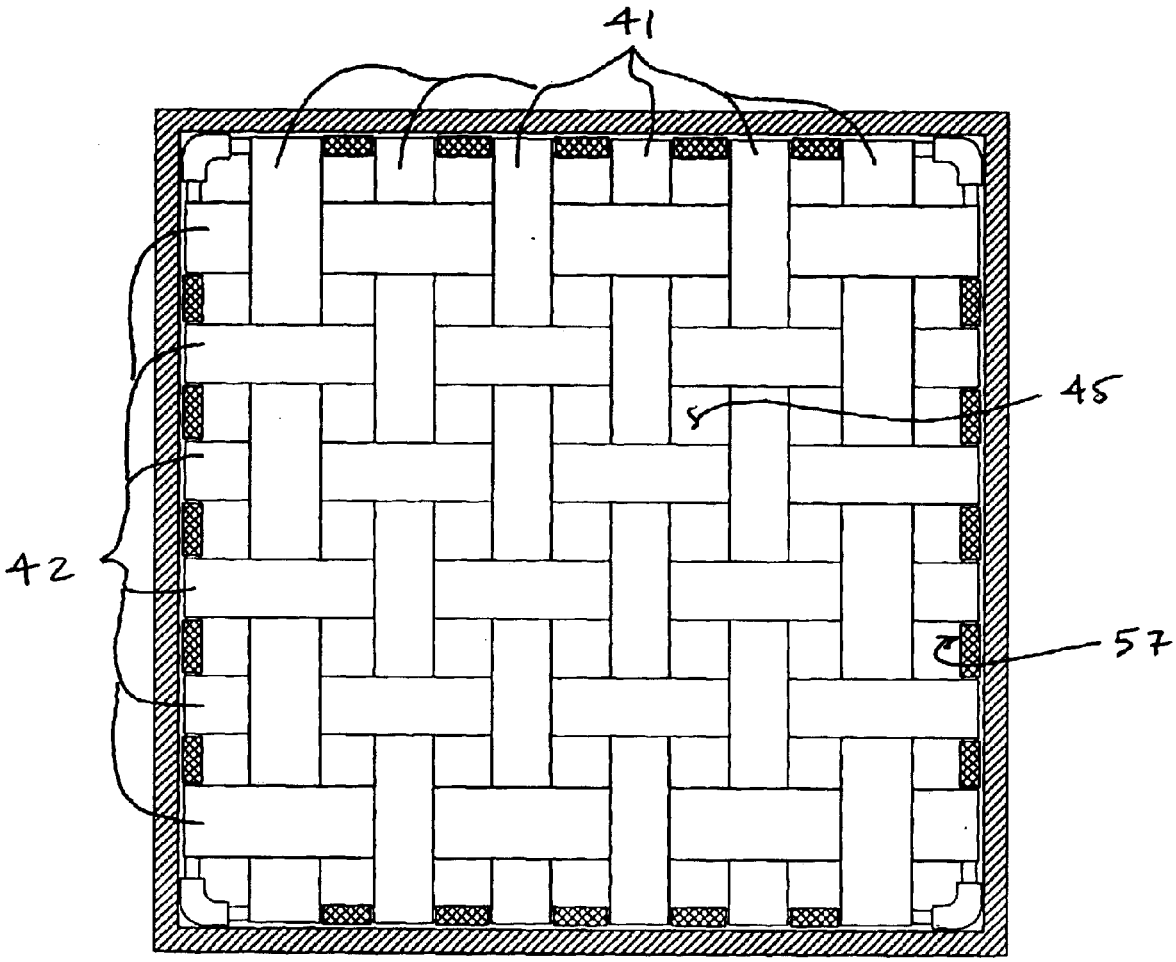
FIG. 3 is a plan view of an embodiment of the floral transport apparatus depicting the upper mesh layer of woven bands.
Figure 4:
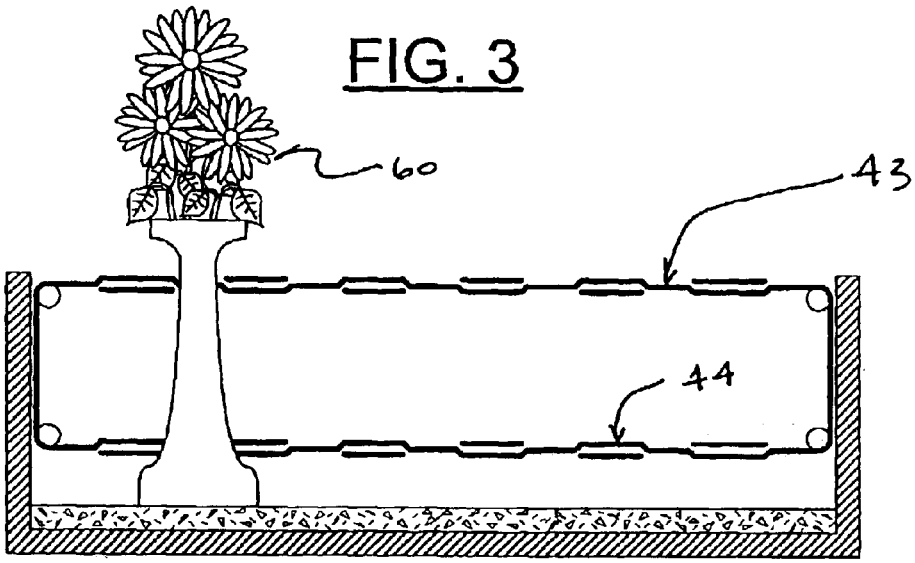
FIG. 4 is a section view of an embodiment of the floral transport apparatus depicting the upper mesh layer and lower mesh layer holding a floral arrangement.

The floral transport device 10 further comprises a support carriage 40 for providing lateral restraint to each flower arrangement 60. The support carriage 40 comprises a set of longitudinal elastic bands 41 and a set of lateral elastic bands 42 arranged in an over-crossing and under-crossing woven pattern to form a top mesh 43 and a bottom mesh 44 (as shown in FIGS. 3 and 4). The bands maybe fabricated from a durable elastic material including, but not limited to, rubber, spandex, or an elastic nylon blend.

Figure 5:
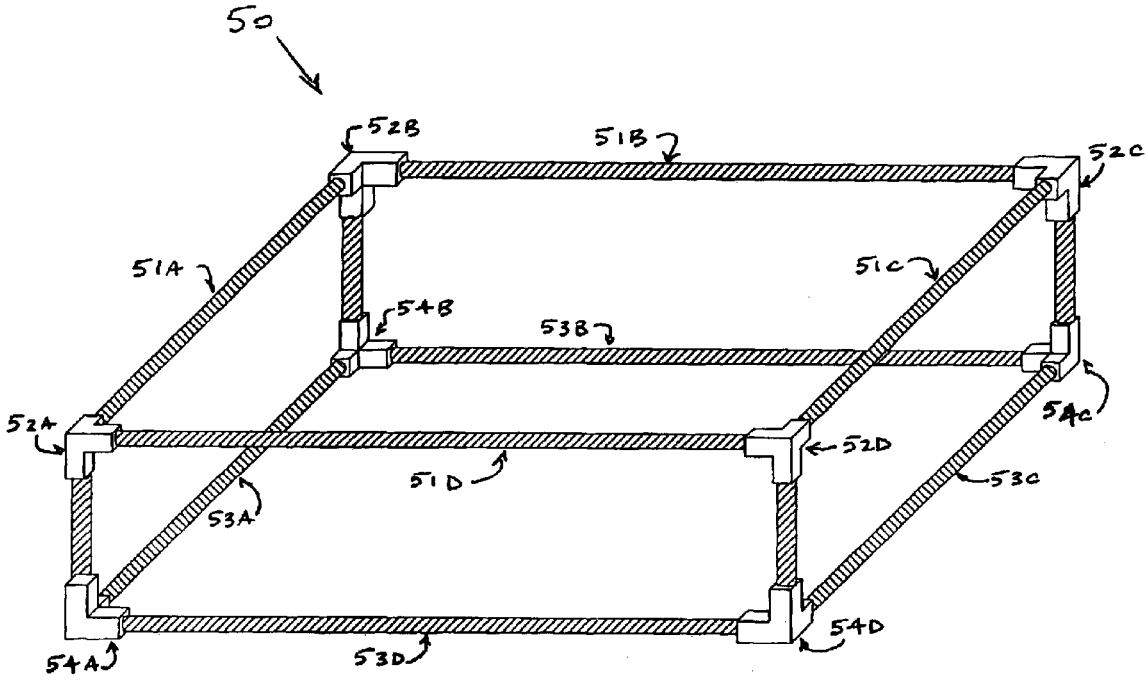
FIG. 5 is a perspective view of an embodiment of the box frame of the support carriage for use in holding the longitudinal and lateral sets of elastic bands.

The longitudinal and lateral sets of bands 41, 42 are supported by and stretched over a box frame 50. The box frame 50 (as shown in FIG. 5) comprises: (1) a set of four horizontal members 51A, 51B, 51C, 51D interconnected by four connecting joints 52A, 52B, 52C, 52D to form an upper frame for supporting the top mesh of bands 43; (2) a set of four horizontal members 53A, 53B, 53C, 53D interconnected by four connecting joints 54A, 54B, 54C, 54D to form a lower frame for supporting the lower mesh of bands 44; and (3) a set of four vertical members 55A, 55B, 55C, 55D for connecting the four joints 52A, 52B, 52C, 52D of the upper frame to the four joints 54A, 54B, 54C, 54D of the lower frame. The horizontal and vertical members may be, but are not limited to, wooden rods, PVC pipe, or light gauge metal tubes. The joints may be, but are not limited to, PVC three-way pipe joints. Alternatively, the each vertical member may be fabricated from extruded plastic with integral 90 degree joints formed on each end for receiving the horizontal members.

Figure 6:
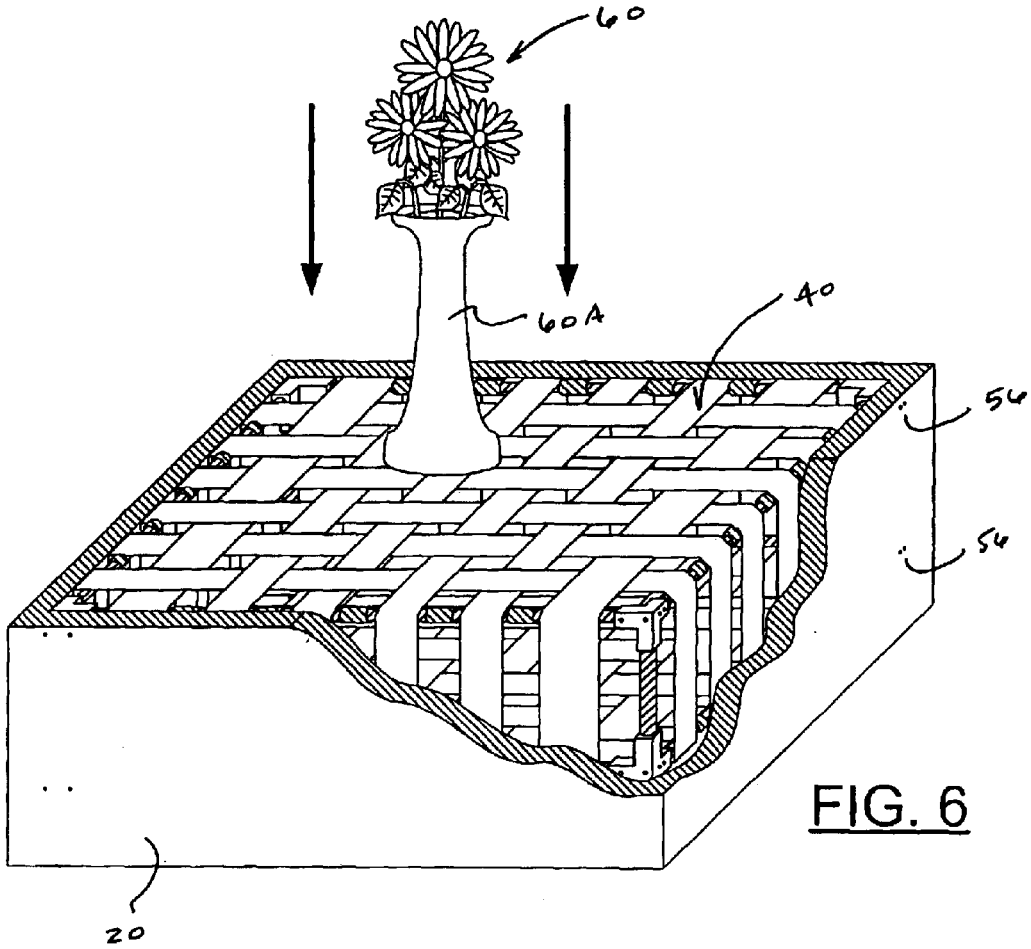
FIG. 6 is a cutaway perspective view of an embodiment of the floral transport apparatus depicting a floral arrangement being moved downward into engagement with the upper and lower mesh layers of elastic bands.
Figure 7:
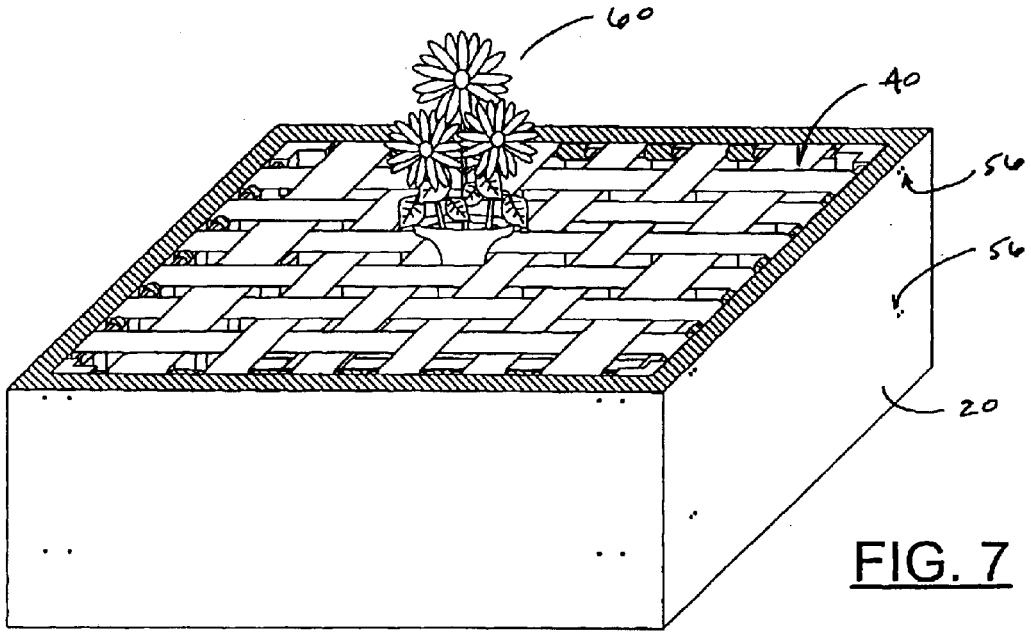
FIG. 7 is a perspective view of an embodiment of the floral transport apparatus depicting a floral arrangement held in engagement with the upper and lower mesh layers of elastic bands.

The support carriage 40 is attached to the container 20 preferably by a set of through-bolts 56 connecting each joint 52A, 52B, 52C, 52D, 54A, 54B, 54C, 54D of the box frame 50 to the four inside walls of the container (as shown in FIGS. 6 and 7). It is intended, however, that the support carriage may be attached to the box frame by any conventional means including, but not limited to, rivets, bolts, screws, clasps, ties, snaps, hooks, and latches.

Each band in both the longitudinal set 41 and lateral set 42 is separated from adjacent bands by a spacer 57 (as shown in FIG. 3). Each spacer 57 comprises a tubular member preferably fabricated from low density plastic, but could be formed from any hardened material including, but not limited to, any plastic or rubber material. Each spacer 57 has an axial bore therethrough for sliding engagement with the horizontal members 51A, 51B, 51C, 51D, 53A, 53B, 53C, 53D of the box frame 50. While this embodiment of the present invention is described with independent spacers for sliding engagement with the box frame, it is intended that another embodiment of the present invention includes spacers formed integrally with the box frame.

Referring to FIGS. 6 and 7, to insert a floral arrangement 60 into the floral transport device 10, the vessel 60A of the arrangement is threaded through a gap 45 in the top mesh 43 (as shown in FIGS. 3 and 4) and a corresponding gap in the bottom mesh 44. The set of longitudinal bands 41 and the set of lateral bands 42 are in tension and stretch to allow the vessel to pass downward therethrough to rest on the mat 30. The resulting tension force in the bands acts to prevent the top and bottom of the vessel from moving laterally; thus, the arrangement is prevented from tipping over. A plurality of arrangements employing various sized vessels maybe set in the floral transport device by placing each vessel in a predetermined gap in the top and bottom mesh to isolate each arrangement.

Figure 8:
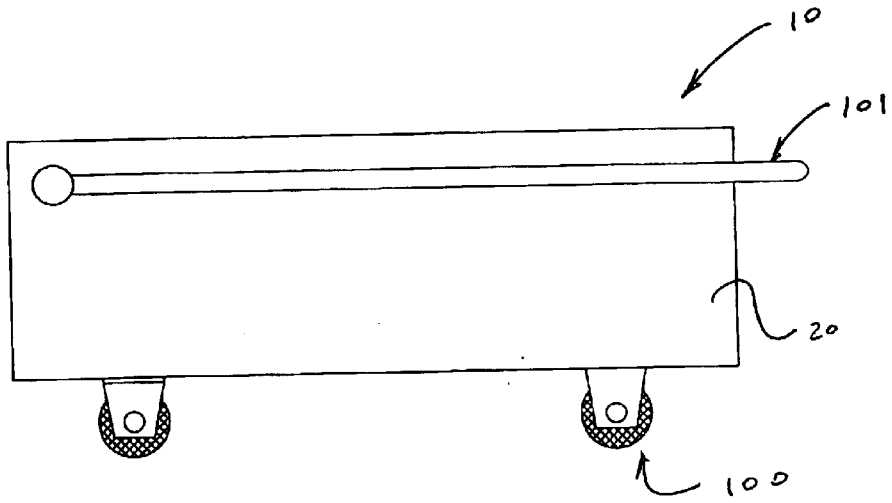
FIG. 8 is an elevation view of an embodiment of the floral transport apparatus depicting a set of casters attached to the container and a handle in the stored position.
Figure 9:
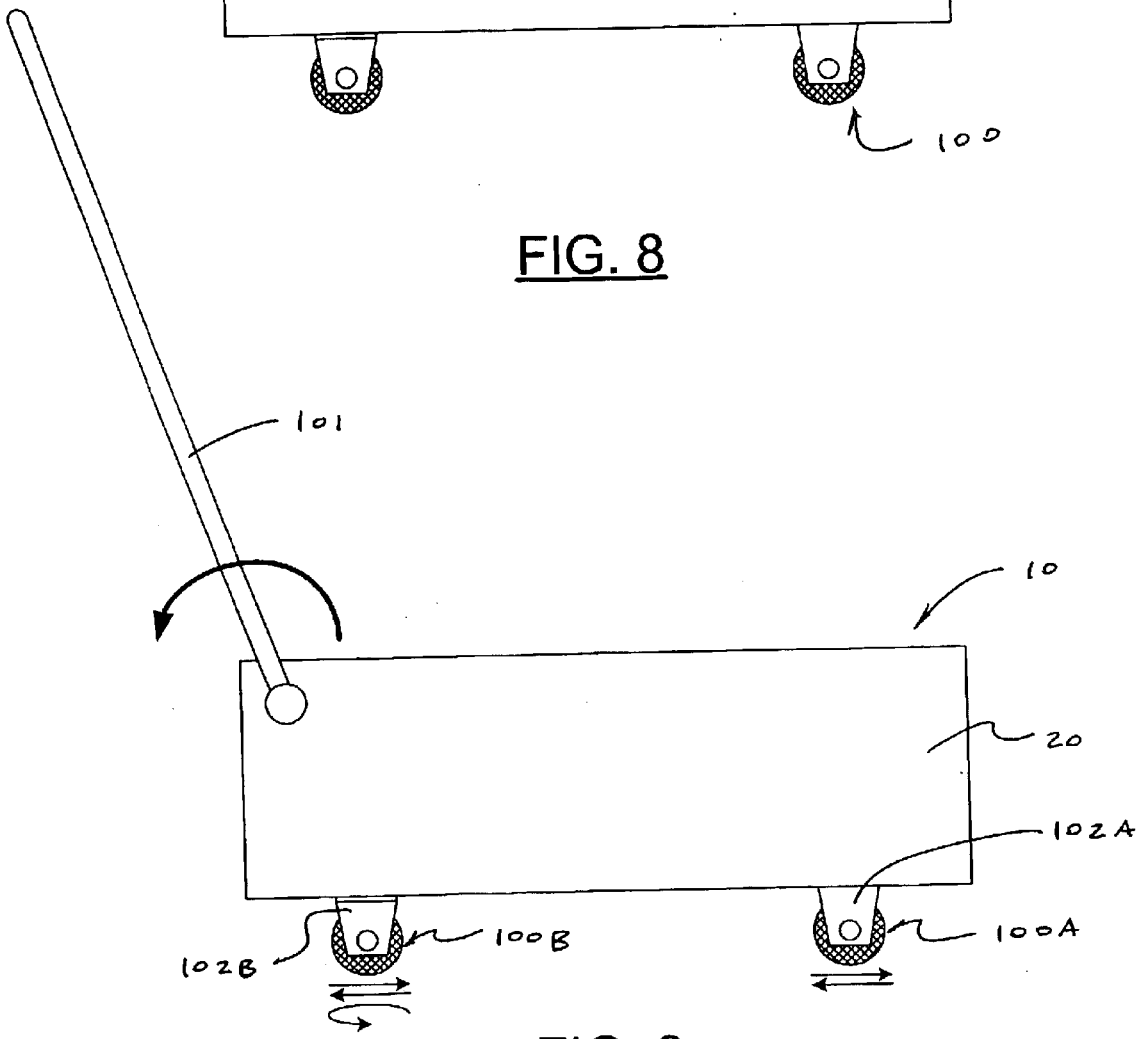
FIG. 9 is an elevation view of an embodiment of the floral transport apparatus depicting a set of casters attached to the container and a handle in the upright position.

In another embodiment of the present invention, the floral transport apparatus includes a device for allowing a single delivery person to move the apparatus outside of the delivery vehicle. Referring to FIGS. 8 and 9, the floral transporter device 10 includes a set of casters 100 and a moveable handle 101 to allow the delivery person to push or pull the container 20 of the transport device. The set of casters 100 includes two front wheels 100A each of which is attached to the bottom of the container 20 by a fixed bracket 102A. The set of casters 100 also includes two back wheels 100B each of which is attached to the bottom of the container 20 by a swivel bracket 102B. The swivel bracket 102B allows the back wheels 100B rotate 360 degrees around a vertical axis such that the floral transport device 10 can be turned when being pushed or pulled by the delivery person. The back wheels 100B also include a hand-activated locking means for preventing the swivel bracket 102B to rotate thus locking the back wheels during vehicular transport. Moreover, a seal is arranged between each caster and the container 20 to prevent water leakage from occurring at the attached brackets 102A and 102B. The handle 101 is moveable between a first position or "stored position" where the handle is folded over to allow the floral transport device 10 to be transported in a delivery vehicle and a second position or "upright position" to allow the delivery person to move the floral transport device outside of the delivery vehicle.

Figure 10:
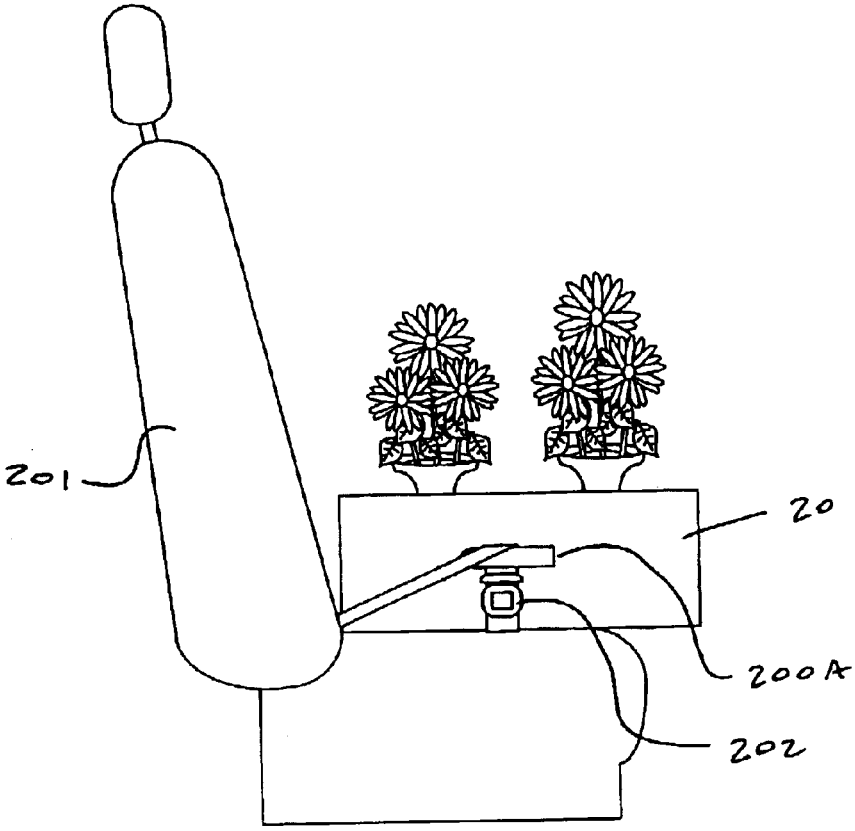
FIG. 10 is an elevation view of an embodiment of the floral transport apparatus depicting a seat belt clip for securing the container to an automobile seat.
Figure 11:
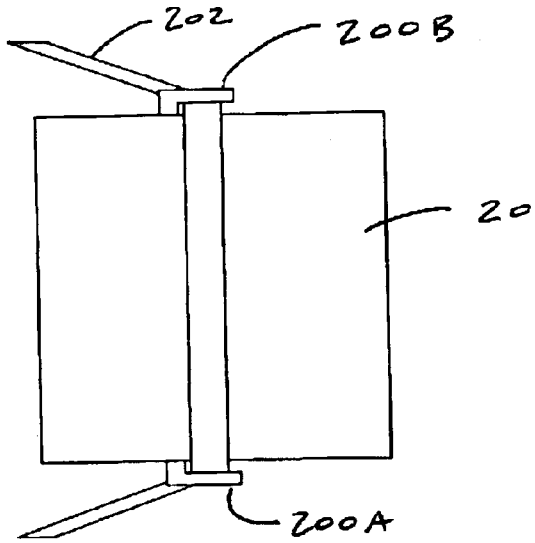
FIG. 11 is a bottom view of an embodiment of the container depicting the bottom base of the container and an automobile seatbelt run beneath the container.

In still another embodiment of the present invention, the floral transport apparatus includes a device to secure the apparatus while in a delivery vehicle. Referring to FIGS. 10 and 11, the floral transport device 10 includes a set of clips 200A, 200B for attaching the container 20 to the seat 201 of a delivery vehicle via a seat belt 202. To attach the container 20 to the seat 201, the seatbelt 202 is first latched together beneath the container. Then, each end of the latched seat belt 201 is looped over the clips 200A, 200B to secure the container 20 to the seat 201.

Figure 12:
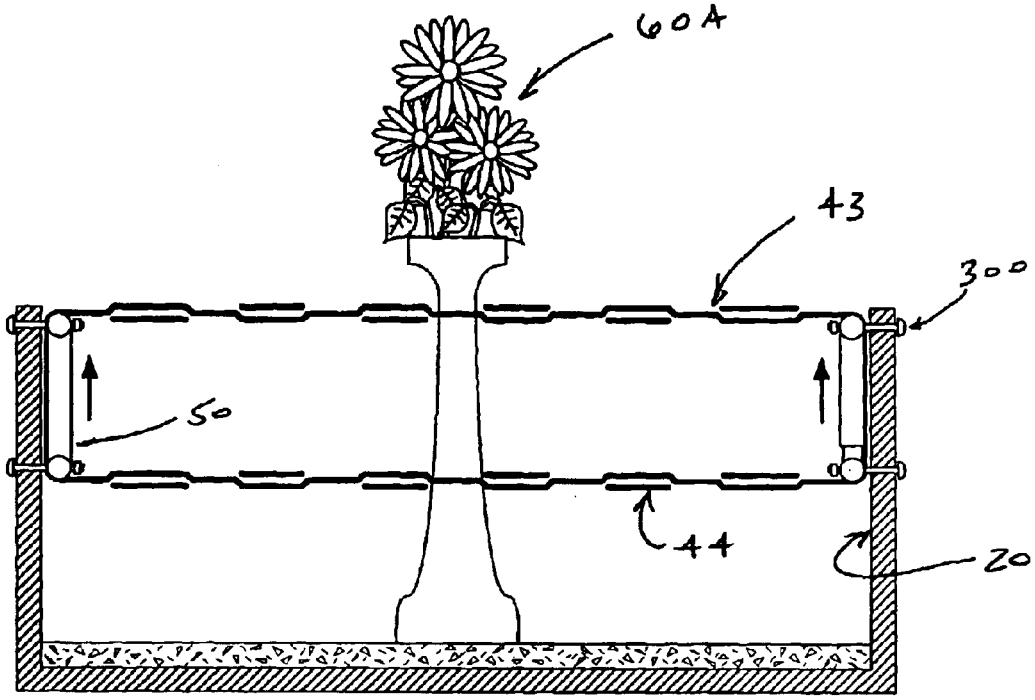
FIG. 12 is a section view of an embodiment of the floral transport apparatus depicting the box frame in an upper position to hold a relatively tall floral arrangement.
Figure 13:
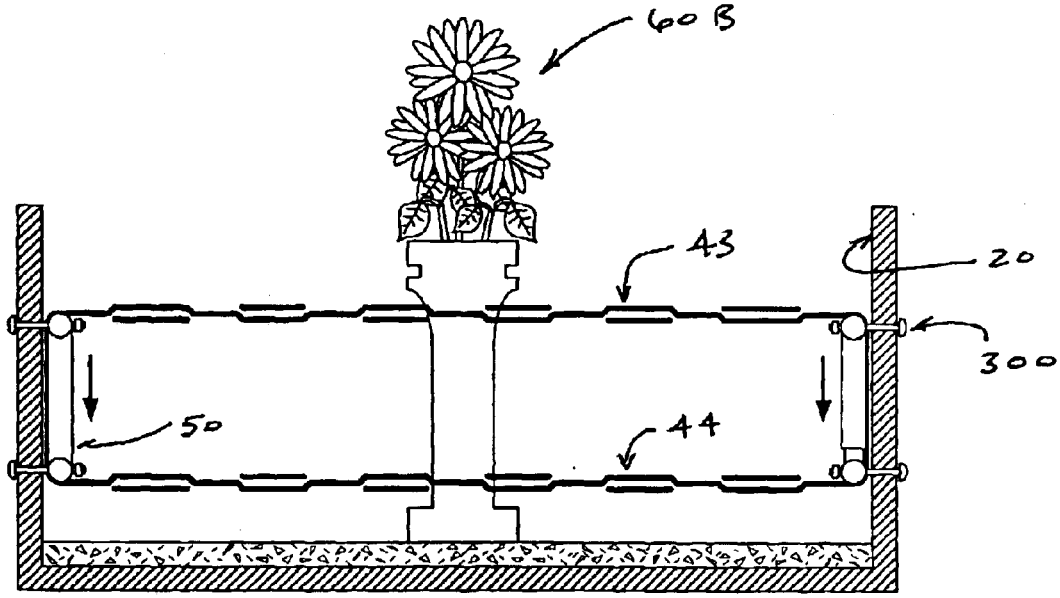
FIG. 13 is a section view of an embodiment of the floral transport apparatus depicting the box frame in a lower position to hold a relatively short floral arrangement.

In yet another embodiment of the present invention, the floral transport apparatus includes a means for adjusting the height of the support carriage to accommodate floral arrangements of various heights. The box frame 50 may be attached to the container 20 in an upper position to account for relatively tall arrangements 60A (as shown in FIG. 12) or in a lower position to account for relatively short arrangements 60B (as shown in FIG. 13). Referring to FIGS. 12 and 13, Preferably, a set of locking bolts 300 is used to hold the box frame 50 in either the upper position or the lower position.

In another embodiment of the present invention, the container includes a set of built-in handles such that the delivery person can easily manage and move the floral transport apparatus by hand.

In the specification and appended claims: (1) the term "operatively connected" is used to mean "in direct connection with" or "in connection with via another element"; and (2) the term "set" is used to mean "one" or "more than one."

What is claimed is:

1. Apparatus for holding articles for transportation comprising:

a rigid container which has a bottom base, a plurality of side walls, and an open top opposite the bottom base;

an upper mesh layer operatively connected to the container;

a lower mesh layer operatively connected to the container between the bottom base and the upper mesh layer; and a box frame arranged inside the container and operatively connected to the container for supporting the upper mesh layer and the lower mesh layer, said box frame comprising: (i) a first set of rigid horizontal members operatively connected together to form a quadranular upper frame, (ii) a second set of rigid horizontal members operatively connected together to form a quadrangular lower frame, and (iii) a set of vertical members, each vertical member having an upper end operatively connected to the upper frame and a lower end operatively connected to the lower frame.

2. Apparatus of claim 1 wherein the upper mesh layer and the lower mesh layer comprise: (i) a first set of elastic bands stretched around the upper frame and lower frame of the box frame, each elastic band of the first set arranged parallel to adjacent elastic bands of the first set; and (ii) a second set of elastic bands stretched around the upper frame and lower frame of the box frame, each elastic band of the second set arranged parallel to adjacent elastic bands of the second set and each elastic band of the second set arranged perpendicular to each elastic band of the first set.

3. Apparatus of claim 2 further comprising a plurality of spacers for sliding engagement with the set of horizontal members of the upper box frame and the set of horizontal members of the lower box frame, said spacers being arranged between each elastic band of the first set to hold the first set of elastic bands in a parallel arrangement and said spacers being arranged between each elastic band of the second set to hold the second set of elastic bands in a parallel arrangement.

4. Apparatus of claim 3 wherein each elastic band of the second set is woven between each elastic band of the first set in an alternating over-passing and under-passing pattern to form the upper mesh layer and the lower mesh layer.

5. Apparatus of claim 4 wherein the container is a box fabricated from a hardened plastic material.

6. Apparatus of claim 5 further comprising a shock-absorbent mat arranged between the bottom base of the container and the lower mesh layer.

7. Apparatus of claim 6 wherein the mat is fabricated from a closed-cell sponge material.

8. Apparatus of claim 7 further comprising a set of casters attached to the bottom of the container for moving the apparatus.

9. Apparatus of claim 8 further comprising a handle attached to the container.

10. Apparatus of claim 4 further comprising at least one clip attached to the side walls of the container for connection with a seatbelt to hold the apparatus in a seat during transportation.

11. Apparatus for holding and transporting at least one floral arrangement comprising:

a rigid container box which has a bottom base, a plurality of side walls, and an open top opposite the bottom base;

a box frame arranged inside the container box and operatively connected to the container box, said box frame comprising: (i) a first set of rigid horizontal members operatively connected together to form a quadrangular upper frame, (ii) a second set of rigid horizontal members operatively connected together to form a quadrangular lower frame, and (iii) a set of vertical members, each vertical member having an upper end operatively connected to the upper frame and a lower end operatively connected to the lower frame;

a first set of elastic bands stretched around the upper frame and lower frame of the box frame, each elastic band of the first set arranged parallel to adjacent elastic bands of the first set;

a second set of elastic bands stretched around the upper frame and lower frame of the box frame in an arrangement whereby: (i) each elastic band of the second set arranged parallel to adjacent elastic bands of the second set; (ii) each elastic band of the second set arranged perpendicular to each elastic band of the first set; and (iii) each elastic band of the second set is woven between each elastic band of the first set in an alternating over-passing and under-passing pattern to form the upper mesh layer and the lower mesh layer; and a plurality of spacers for sliding engagement with the set of horizontal members of the upper box frame and the set of horizontal members of the lower box frame, said spacers being arranged between each elastic band of the first set to hold the first set of elastic bands in a parallel arrangement and said spacers being arranged between each elastic band of the second set to hold the second set of elastic bands in a parallel arrangement.

12. Apparatus of claim 11 wherein the box container is fabricated from a hardened plastic material.

13. Apparatus of claim 12 further comprising a shock-absorbent mat arranged between the bottom base of the box container and the lower mesh layer.

14. Apparatus of claim 13 wherein the mat is fabricated from a closed-cell sponge material.

15. Apparatus of claim 13 further comprising a set of casters attached to the bottom of the container for moving the apparatus.

16. Apparatus of claim 15 further comprising a handle attached to the container box for moving the container via the set of casters.

17. Apparatus of claim 16 further comprising at least one clip attached to the side wails of the container for connection with a seatbelt to hold the apparatus in a seat during transportation.

18. Apparatus of claim 11 wherein the box frame can be moved between a lower position in the container box for holding one or more small floral arrangements and an upper position in the container box for holding one or more large floral arrangements.

19. Apparatus of claim 11 wherein the container box further comprises a set of handles formed therein for moving the container box by hand.

* * * * *